US011652296B2

(12) United States Patent
Kim et al.

(10) Patent No.: US 11,652,296 B2
(45) Date of Patent: May 16, 2023

(54) MICROSTRIP ANTENNA AND MICROSTRIP ANTENNA MODULE INCLUDING THE SAME

(71) Applicant: Samsung Electro-Mechanics Co., Ltd., Suwon-si (KR)

(72) Inventors: Sanghyun Kim, Suwon-si (KR); Minhoon Kim, Suwon-si (KR); Jaehyun Shin, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 58 days.

(21) Appl. No.: 17/224,331

(22) Filed: Apr. 7, 2021

(65) Prior Publication Data

US 2022/0181780 A1 Jun. 9, 2022

(30) Foreign Application Priority Data

Dec. 3, 2020 (KR) ..... 10-2020-0167486

(51) Int. Cl.
*H01Q 1/48* (2006.01)
*H01Q 9/04* (2006.01)
*H01Q 9/16* (2006.01)

(52) U.S. Cl.
CPC ..... *H01Q 9/045* (2013.01); *H01Q 1/48* (2013.01); *H01Q 9/16* (2013.01)

(58) Field of Classification Search
CPC ..... H01Q 9/045; H01Q 1/48; H01Q 9/16
See application file for complete search history.

(56) References Cited

U.S. PATENT DOCUMENTS 4,095,227 A * 6/1978 Kaloi ..... H01Q 9/0421 343/700 MS
5,703,600 A 12/1997 Burrell et al.
7,522,105 B1 4/2009 LaComb
2018/0062263 A1* 3/2018 Ueda ..... H01Q 21/06

FOREIGN PATENT DOCUMENTS

JP 2007-142570 A 6/2007
JP 2007274317 A * 10/2007

OTHER PUBLICATIONS

Johnson, Richard, C., "Antenna Engineering Handbook," McGraw-Hill, Inc., 1992 (pp. 1-47).

* cited by examiner

*Primary Examiner* — Dieu Hien T Duong
(74) *Attorney, Agent, or Firm* — NSIP Law

(57) ABSTRACT

An antenna including a substrate, a radiation portion connected to a feed line, disposed on a layer of the substrate, and including a conductor having an opening, and a coupling member connected to a ground portion and disposed within the opening spaced apart from the conductor by a gap.

30 Claims, 19 Drawing Sheets

Gap(g)=0㎛

Gap(g)=10㎛

Gap(g)=20㎛

MICROSTRIP ANTENNA AND MICROSTRIP ANTENNA MODULE INCLUDING THE SAME

CROSS-REFERENCE TO RELATED APPLICATIONS

This application claims the benefit under 35 USC 119(a) of Korean Patent Application No. 10-2020-0167486 filed in the Korean Intellectual Property Office on Dec. 3, 2020, the entire disclosure of which is incorporated herein by reference for all purposes.

BACKGROUND

1. Field

The present disclosure relates to a microstrip antenna and a microstrip antenna module including the same.

2. Description of the Background

Data consumption is increasing exponentially as a wireless communication market greatly develops. In order to meet demand for the increase in this wireless communication traffic, a millimeter wave band capable of securing a wider bandwidth, not a saturated existing frequency band, is in the spotlight. Since the millimeter wave has a short wavelength due to characteristics of radio waves, it has an advantage of transmitting a large capacity of information as it may down-size antennas and devices and may use a wide bandwidth, and particularly, 60 GHz band Wireless Gigabit (WiGig) technology development is actively underway.

The WiGig is an ultra-high-speed short-range wireless communication standard operating in the 60 GHz frequency band, and is a technology that is optimized for short-range transmission between devices of a digital image service. It is a technology that wirelessly replaces an HDMI cable (an optical cable) in a field of high-speed image transmission between devices that an existing Wi-Fi could not reach due to a limitation of a transmission speed, and as non-compression large capacity motion picture transmission using a fast transmission speed becomes possible, it is expected to be used for various multimedia devices in the future.

Recently, an antenna technology has focused on downsizing and a beamforming technology. In the widely used microstrip antenna, an effective antenna space has reduced due to the light, thin, short, and small size of mobile devices, and it is difficult to perform beamforming because the beam is formed in a unique direction.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in simplified form that are further described below in the Detailed Description. This Summary is not intended to identify key features or essential features of the claimed subject matter, nor is it intended to be used as an aid in determining the scope of the claimed subject matter.

In one general aspect, an antenna includes a substrate, a radiation portion connected to a feed line, disposed on a layer of the substrate, and including a conductor including an opening, and a coupling member connected to a ground portion and disposed within the opening spaced apart from the conductor by a gap.

The radiation portion and the coupling member may be disposed at least partially on the same layer.

The radiation portion may include a first edge and a second edge facing each other, and the feed line may be disposed closer to the first edge of the radiation portion than the opening.

The opening may be elongated along the second edge of the radiation portion.

The coupling member may include a plurality of circular pads spaced apart from each other within the opening.

The opening may include a plurality of concave portions respectively corresponding to the plurality of circular pads and formed such that the conductor is protruded to surround the edge shape of each circular pad.

The coupling member may include a strip-shaped pad elongated along the edge of the opening.

The opening may include a plurality of circular openings spaced apart from each other along the second edge of the radiation portion.

The coupling member may include a plurality of circular pads each positioned to correspond to a circular opening of the plurality of circular openings.

The radiation portion may be disposed to be biased to one side on the substrate so that the first edge is aligned with one edge of the substrate.

The coupling member may be connected to the ground portion through a conductive via extending in a thickness direction of the substrate, and the coupling member may have a greater width than the diameter of the conductive via.

The antenna may be a microstrip antenna.

The substrate may be a dielectric material.

An electronic device may include the antenna.

The electronic device may further include one or more of a dipole antenna and a radiation patch.

In another general aspect, an antenna module includes a substrate, at least one antenna disposed on one surface of the substrate, and at least one electronic element mounted on an other surface of the substrate. The antenna includes a radiation portion connected to a feed line, disposed on a layer of the substrate, and including a conductor having an opening, and a coupling member connected to a ground portion and disposed within the opening spaced apart from the conductor by a gap.

An electronic device may include the antenna module.

The antenna module may further include one or more of a dipole antenna and a radiation patch.

In another general aspect, an antenna includes a radiation portion including a conductor, an opening through the conductor configured to surround a coupling member in the opening with a gap between the conductor and the coupling member, and a feed portion disposed spaced apart from the opening, wherein the opening and the feed portion are disposed at facing edges of the conductor.

The antenna may further include a feed line connected to the feed portion, and the coupling member disposed in the opening connected to a ground portion through a substrate, wherein the conductor may be disposed on the substrate.

The coupling member may include a plurality of pads disposed in a row near an edge of the facing edges opposite to the feed portion.

The opening may include a plurality of openings connected to each other and corresponding to the plurality of pads.

The antenna may further include a via connected to the ground portion, and extending to the coupling member, wherein the coupling member may extend from the via toward the conductor in the opening.

In another general aspect, an electronic device includes an antenna including a radiation portion having an opening and a feed portion spaced apart from the opening, wherein the opening and the feed portion are disposed at facing edges of the radiation portion, and a coupling member connected to a ground portion disposed in the opening and spaced apart from the radiation portion by a gap.

The antenna may further include a substrate, wherein the radiation portion may be disposed on the substrate, and a feed line connected to the feed portion, wherein the coupling portion may be connected to the ground portion through the substrate.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative sizes, proportions, and depictions of elements in the drawings may be exaggerated for clarity, illustration, and convenience.

DETAILED DESCRIPTION

Figure 1:
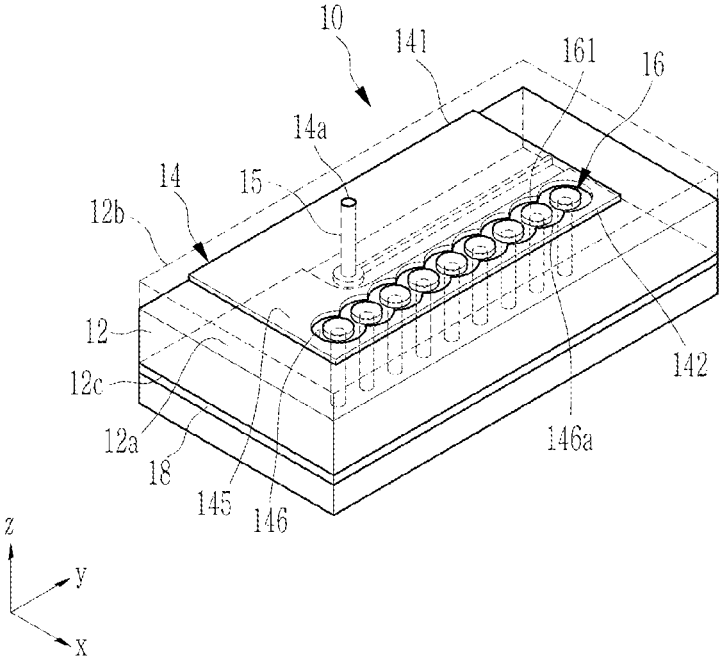
FIG. 1 is a perspective view of a microstrip antenna including a coupling member according to an embodiment.

Hereinafter, while example embodiments of the present disclosure will be described in detail with reference to the accompanying drawings, it is noted that examples are not limited to the same.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of functions and constructions that would be well known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure.

Herein, it is noted that use of the term "may" with respect to an example or embodiment, for example, as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Spatially relative terms such as "above," "upper," "below," "lower," and the like may be used herein for ease of description to describe one element's relationship to another element as illustrated in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

Due to manufacturing techniques and/or tolerances, variations of the shapes illustrated in the drawings may occur. Thus, the examples described herein are not limited to the specific shapes illustrated in the drawings, but include changes in shape that occur during manufacturing.

The features of the examples described herein may be combined in various ways as will be apparent after an understanding of this disclosure. Further, although the examples described herein have a variety of configurations, other configurations are possible as will be apparent after an understanding of this disclosure.

One aspect of the present disclosure is to provide a microstrip antenna and a microstrip antenna module that are advantageous for down-sizing and beamforming without a complicated design.

Figure 2:
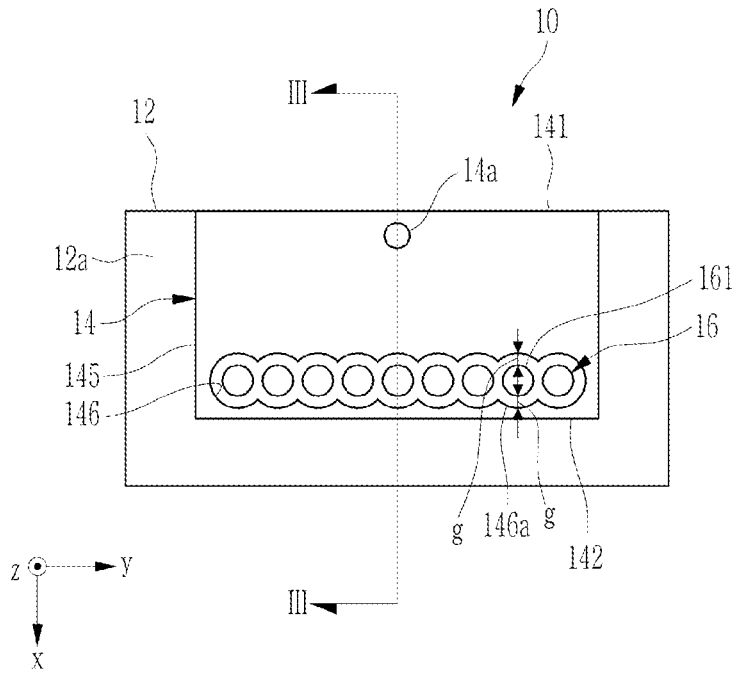
FIG. 2 is a top plan view of a microstrip antenna including a coupling member according to an embodiment.

FIG. 1 is a perspective view of a microstrip antenna including a coupling member according to an embodiment, and FIG. 2 is a top plan view of a microstrip antenna including a coupling member according to an embodiment.

Referring to FIG. 1 and FIG. 2, a microstrip antenna 10 according to the present embodiment includes a dielectric material substrate 12, a radiation portion 14, and a coupling member 16 disposed in the dielectric material substrate 12. The radiation portion 14 may be disposed on the first layer 12*a* of the dielectric material substrate 12 while being connected to the feed line 15 through the feed portion 14*a*, and the coupling member 16 may be disposed on the first layer 12*a* of the dielectric material substrate 12 while being connected to the ground portion 18. That is, the radiation portion 14 and the coupling member 16 may be positioned on the same layer of the dielectric material substrate 12. However, depending on a desired design of the antenna, the radiation portion 14 and the coupling member 16 may be positioned on different layers rather than on the same layer or on different layers partially with a height difference.

The radiation portion 14 includes a conductor 145 and a penetrating opening 146 may be formed in the conductor 145. The conductor 145 may be formed to have a plane surface of a quadrangle including, for example, a rectangular shape or a square shape. The coupling member 16 may be disposed to be separated from the conductor 145 in the opening 146 with a gap.

The radiation portion 14 includes a first edge 141 and a second edge 142 facing each other. Here, the feed portion 14*a* may be disposed closer to the first edge 141 of the radiation portion 14 and the opening 146 may be disposed closer to the second edge 142 of the radiation portion 14. In addition, the opening 146 may be formed by being elongated along the second edge 142 of the radiation portion 14 in they axis direction in the drawing. The coupling member 16 positioned within the opening 146 may be disposed to face the feed portion 14*a*.

As described above, since the feed portion 14*a* and the coupling member 16 have the structure facing each other while being positioned at opposite edges of the radiation portion 14, a current flow (an electrical length) required for the operating frequency of the antenna may be secured. That is, an electric field started from the feed portion 14*a* passes through the conductor 145 of the radiation portion 14 and may be coupled to the coupling member 16 in the gap, the current again flows from the coupling member 16 to the ground portion 18, and the electrical length required for the operating frequency may be secured.

In the present embodiment, the coupling member 16 may include a plurality of circular pads 161. A plurality of circular pads 161 constituting the coupling member 16 may be disposed to be displaced apart from the conductor 145 with a gap g within the opening 146 of the conductor 145. In addition, a plurality of circular pads 161 may be arranged to be spaced apart from each other in the opening 146.

The opening 146 may include a plurality of concave portions 146*a* corresponding to each of a plurality of circular pads 161. A plurality of concave portions 146*a* may be formed such that the conductor 145 is protruded to surround the circular pads 161 along the edge shape. Accordingly, the gap g between the circular pads 161 and the conductor 145 in each of a plurality of concave portions 146*a* may be formed to be a uniform distance.

On the other hand, the radiation portion 14 may be disposed to be biased toward one side on the dielectric material substrate 12. For example, the radiation portion 14 may be formed so that the first edge 141 is aligned to one edge of the dielectric material substrate 12. Thus, the feed portion 14*a* may be disposed closer to one edge of the dielectric material substrate 12 than the coupling member 16.

In addition, the dielectric material substrate 12 may further include an upper dielectric layer 12*b* covering the radiation portion 14. Here, the upper dielectric layer 12*b* may fill the gap g between the coupling member 16 of the opening 146 and the conductor 145.

Figure 3:
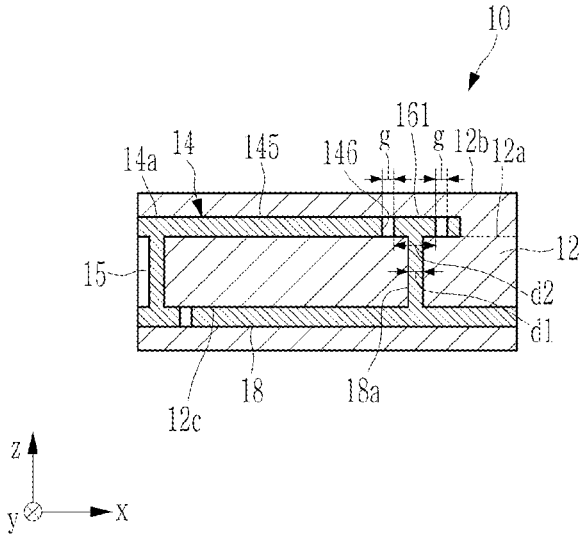
FIG. 3 is a cross-sectional view taken along a line III-III of FIG. 2.

FIG. 3 is a cross-sectional view taken along a line III-III of FIG. 2.

Referring to FIG. 3, the coupling member 16 may be connected to the ground portion 18 through a conductive via 18*a* extending in the thickness direction (the z-axis direction in the drawing) of the dielectric material substrate 12. The ground portion 18 may be positioned on the second surface 12*c* of the dielectric material substrate 12. The conductive via 18*a* may be formed by forming a via hole in the dielectric material substrate 12 and filling the via hole with a conductive material.

In the present embodiment, the circular pads 161 of the coupling member 16 may be formed to have a transverse width or a diameter d2 that is greater than the diameter d1 of the conductive via 18*a*.

Figure 4:
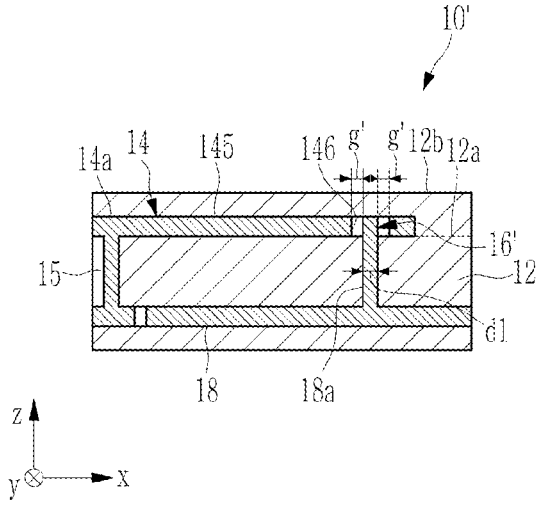
FIG. 4 is a cross-sectional view of a microstrip antenna including a coupling member shown in FIG. 1 according to a variation embodiment.

FIG. 4 is a cross-sectional view of a microstrip antenna including a coupling member shown in FIG. 1 according to a variation embodiment.

Referring to FIG. 4, in the microstrip antenna 10' according to the present variation embodiment, the coupling member 16' may be formed to have the same diameter as the diameter d1 of the conductive via 18*a* connected to the ground portion 18. The coupling member 16' may be disposed to be spaced apart from the conductor 145 by a gap g' within the opening 146 of the conductor 145 constituting the radiation portion 14.

Figure 5:
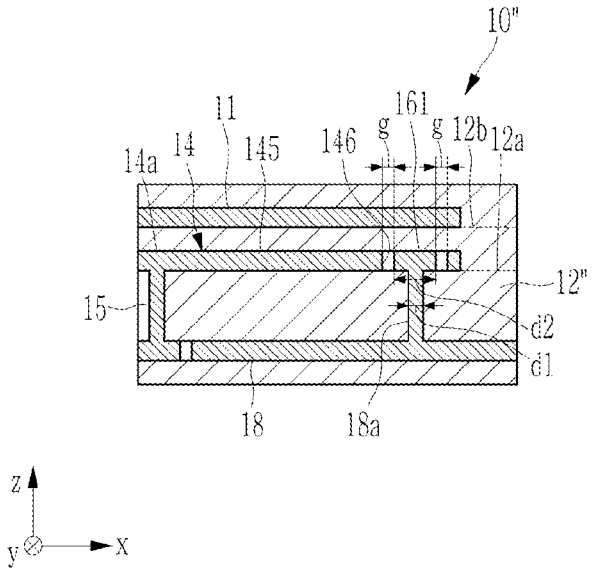
FIG. 5 is a cross-sectional view of a microstrip antenna including a coupling member shown in FIG. 1 according to another variation embodiment.

FIG. 5 is a cross-sectional view of a microstrip antenna including a coupling member shown in FIG. 1 according to another variation embodiment.

Referring to FIG. 5, the microstrip antenna 10" according to the present variation embodiment may include all the structures of the microstrip antenna including the coupling member 16 shown in FIG. 1. That is, the microstrip antenna 10" includes a dielectric material substrate 12", and a radiation portion 14 and a coupling member 16 disposed in the dielectric material substrate 12". The radiation portion 14 may be disposed on the first layer 12*a* of the dielectric material substrate 12" while being connected to the feed line 15 through the feed portion 14*a*, and the coupling member 16 may be disposed on the first layer 12*a* of the dielectric material substrate 12" while being connected to the ground portion 18.

The radiation portion 14 includes the conductor 145 in which the opening 146 is formed, and the coupling member 16 may be disposed to be separated from the conductor 145 with a gap g in the opening 146.

In addition, a coupling patch 11 may be formed on the upper layer of the radiation portion 14. The coupling patch 11 may be disposed to be separated from the conductor 145 of the radiation portion 14 in the thickness direction, and a separate feed line may not be directly connected. For example, the coupling patch 11 may be formed on the upper dielectric layer 12*b*. Therefore, the coupling patch 11 may be antenna-driven by the coupling supply according to the supply to the feed portion 14*a* of the radiation portion 14.

Figure 6:
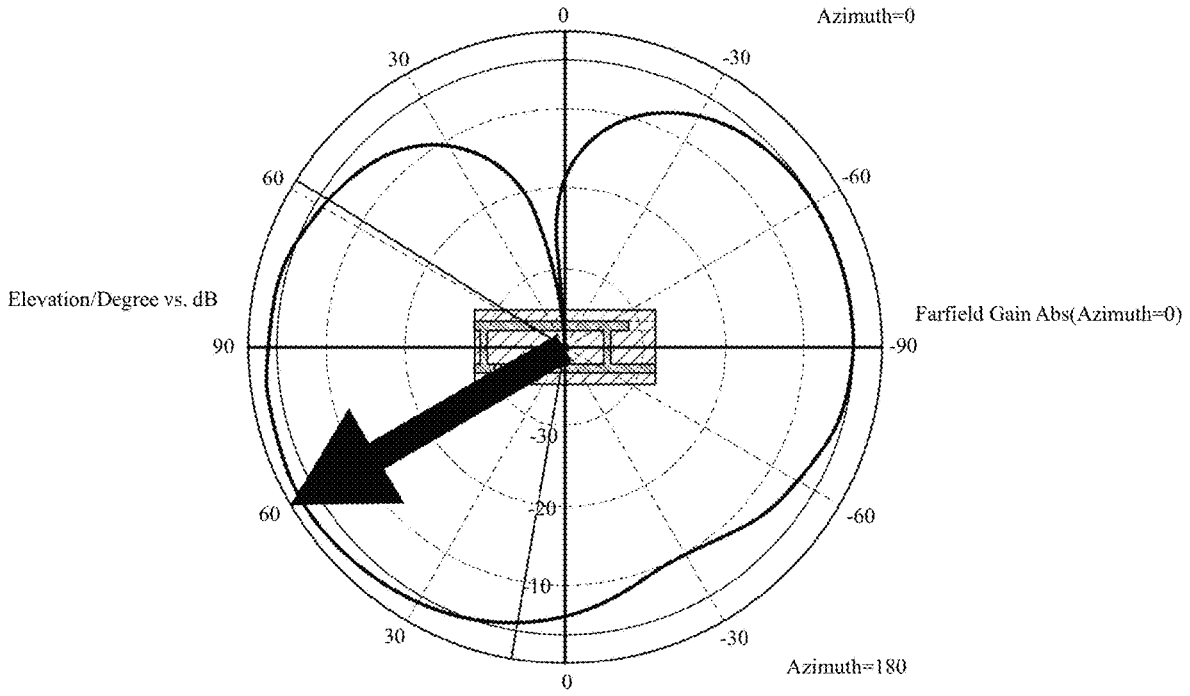
FIG. 6 is a radiation pattern graph of a microstrip antenna according to a comparative example.
Figure 7:
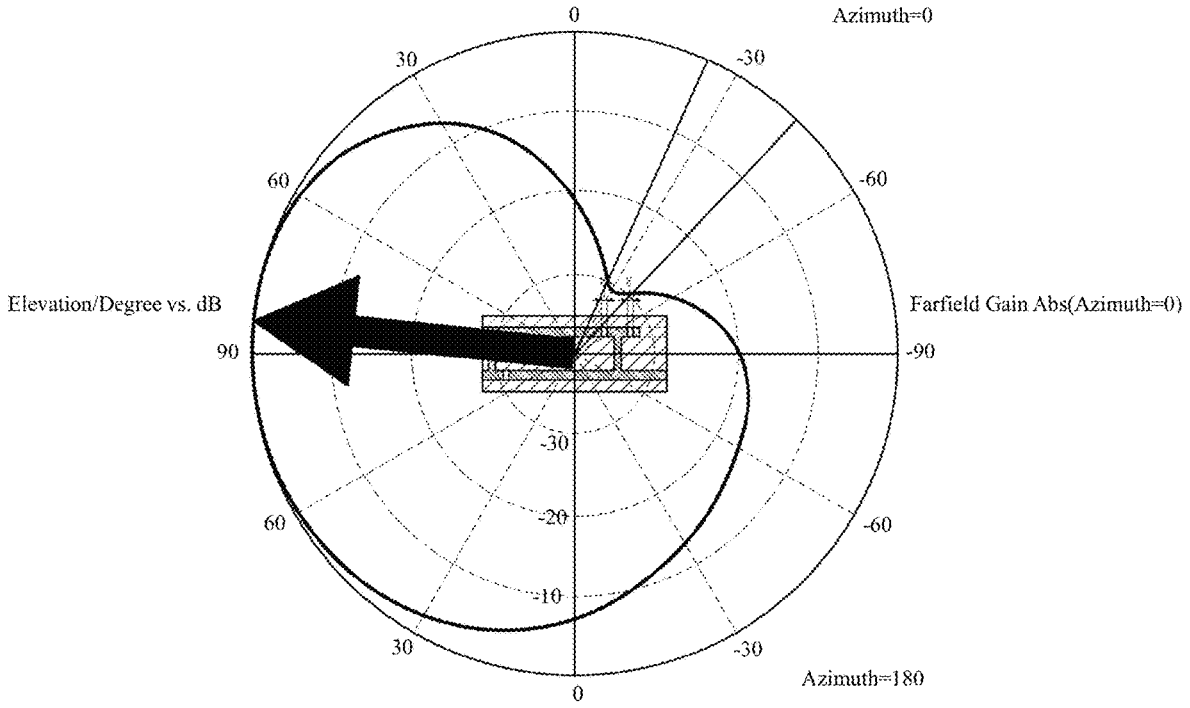
FIG. 7 and FIG. 8 are radiation pattern graphs showing a change of a beam direction according to a size of a gap between a conductor and a coupling member of a radiation portion in a microstrip antenna including a coupling member according to an embodiment of FIG. 1.
Figure 8:
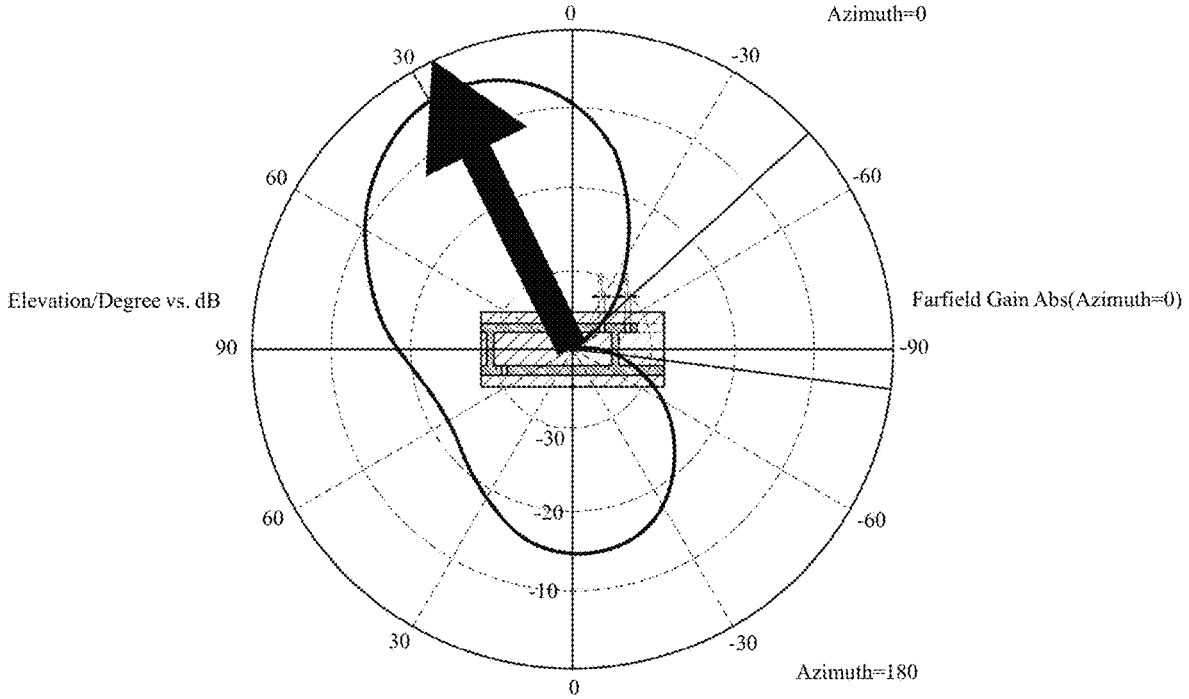

FIG. 6 is a radiation pattern graph of a microstrip antenna according to a comparative example, and FIG. 7 and FIG. 8 are radiation pattern graphs showing a change of a beam direction according to a size of a gap between a conductor and a coupling member of a radiation portion in a microstrip antenna including a coupling member according to an embodiment of FIG. 1. The radiation patterns shown in FIG. 6, FIG. 7, and FIG. 8 are measured and shown in the state that the microstrip antenna is disposed as shown in FIG. 3, that is, the state that the feed portion is disposed on the left in the drawing.

First, referring to FIG. 6, a microstrip antenna according to a comparative example may be an antenna when a gap g between the conductor 145 of the radiation portion 14 and the coupling member 16 is 0 in the embodiment shown in FIG. 1, that is, having a shorting pin structure in which the gap is not formed. In the antenna of the comparative example, it may be confirmed that the radiation mainly occurs in the direction in which the feed portion is positioned, but the beam direction is formed in the lower direction with reference to the radiation portion formed on the dielectric material substrate.

Referring to FIG. 7, in the microstrip antenna 10 according to the present embodiment, when the gap g between the conductor 145 of the radiation portion 14 and the coupling member 16 is 10 μm (microns), the beam direction in the antenna may be confirmed. It may be confirmed that the radiation mainly occurs in the direction in which the feed portion is positioned, but the beam direction is formed in the direction parallel thereto with reference to the radiation portion 14 formed on the dielectric material substrate 12.

Referring to FIG. 8, in the microstrip antenna 10 according to the present embodiment, when the gap g between the conductor 145 of the radiation portion 14 and the coupling member 16 is 20 μm, the beam direction in the antenna may be confirmed. It may be confirmed that the radiation mainly occurs in the direction in which the feed portion is positioned, but the beam direction is formed in the upper direction with reference to the radiation portion 14 formed on the dielectric material substrate 12.

In summary, it may be confirmed that the beam direction of the antenna is basically formed in the direction of the side in which the feed portion is positioned and moves upward with reference to the ground portion as the distance between the conductor of the radiation portion and the coupling member increases. That is, the width of the gap g between the coupling member and the conductor of the radiation portion may adjust the amount of the coupling between the radiation portion and the ground portion, thereby changing the beam direction of the antenna. The user may easily adjust the gap g according to the desired coupling strength, so that the change of the beam direction may be obtained due to the coupling effect without the configuration of a complicated circuit to be suitable for the beamforming.

Figure 9:
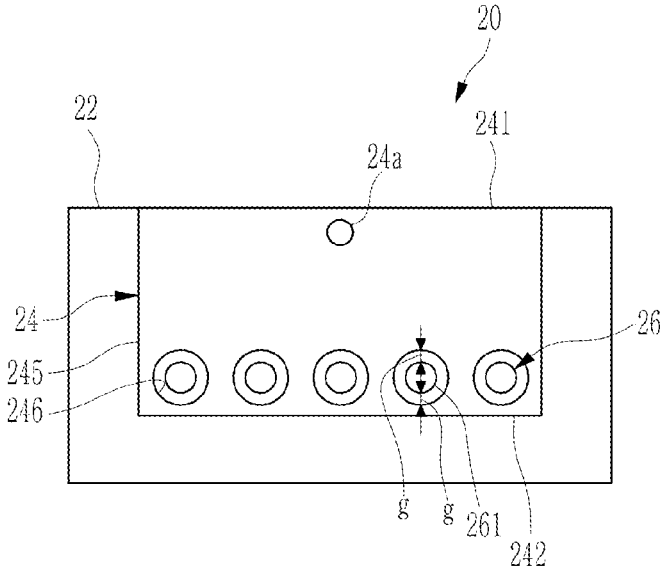
FIG. 9 is a top plan view showing a microstrip antenna including a coupling member according to another embodiment.

FIG. 9 is a top plan view showing a microstrip antenna including a coupling member according to another embodiment.

Referring to FIG. 9, a microstrip antenna 20 according to the present embodiment includes a dielectric material substrate 22, and a radiation portion 24 and a coupling member 26 disposed on the dielectric material substrate 22. The radiation portion 24 is connected to the feed line though the feed portion 24*a*, and the coupling member 26 may be disposed on the same surface of the dielectric material substrate 22 while being connected to the ground portion.

The radiation portion 24 may include a conductor 245 and the conductor 245 may include a penetrated opening 246. The conductor 245 may be formed to have a quadrangle plane shape including, for example, a rectangular shape or square shape.

The radiation portion 24 includes a first edge 241 and a second edge 242 facing each other. Here, the feed portion 24*a* may be disposed closer to the first edge 241 of the radiation portion 24, and the opening 246 may be disposed closer to the second edge 242 of the radiation portion 24.

In the present embodiment, the opening 246 may include a plurality of circular openings separated from each other. The plurality of circular openings may be disposed to be spaced apart from each other along the second edge 242 of the radiation portion 24 and arranged in a line.

The coupling member 26 may include a plurality of circular pads 261. A plurality of circular pads 261 may be positioned corresponding to each of a plurality of circular openings constituting the opening 246. In addition, a plurality of circular pads 261 may be disposed to be respectively spaced apart from the conductor 245 with a gap g within a plurality of circular openings constituting the opening 246. A gap g from the edge of the circular pad 261 to the conductor 245 corresponding to each of the plurality of circular openings may be formed to have a uniform distance.

Figure 10:
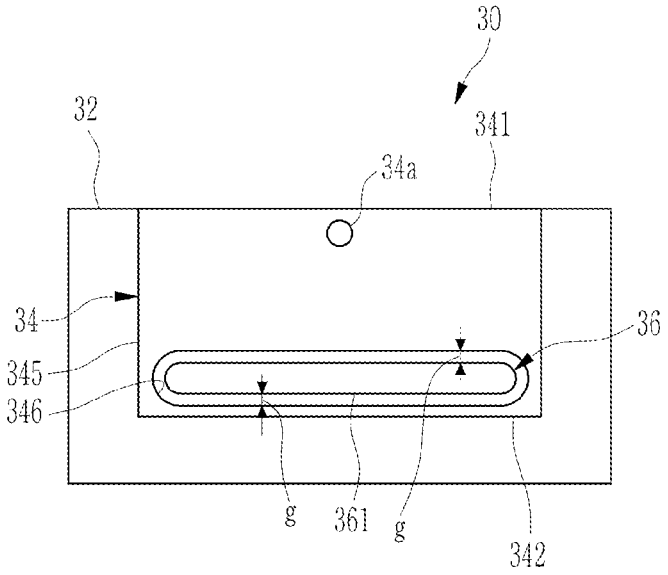
FIG. 10 is a top plan view showing a microstrip antenna including a coupling member according to another embodiment.

FIG. 10 is a top plan view showing a microstrip antenna including a coupling member according to another embodiment.

Referring to FIG. 10, the microstrip antenna 30 according to the present embodiment includes a dielectric material substrate 32, and a radiation portion 34 and a coupling member 36 disposed on the dielectric material substrate 32. The radiation portion 34 may be connected to the feed line through a feed portion 34*a*, and the coupling member 36 may be disposed on the same surface of the dielectric material substrate 32 while being connected to the ground portion.

The radiation portion 34 may include a conductor 345 and a through opening 346 may be formed in the conductor 345. The conductor 345 may be formed to have a quadrangle plane shape including, for example, a rectangular shape or square shape.

The radiation portion 34 includes a first edge 341 and a second edge 342 facing each other. Here, the feed portion 34*a* may be disposed closer to the first edge 341 of the radiation portion 34, and the opening 346 may be disposed closer to the second edge 342 of the radiation portion 34. In addition, the opening 346 may be formed by extending along the second edge 342 of the radiation portion 34.

In the present embodiment, the coupling member 36 may include a pad 361 in the shape of an elongated strip. The strip-shaped pad 361 may be elongated along the edge of the opening 346. In addition, the strip-shaped pad 361 constituting the coupling member 36 may be disposed by being spaced apart from the conductor 345 with a gap g within the opening 346 of the conductor 345. The gap g from the edge of the strip-shaped pad 361 to the conductor 345 in the opening 346 of the conductor 345 may be formed to have a uniform distance. Accordingly, both ends in the length direction of the opening 346 are formed to be rounded and both ends in the length direction of the strip-shaped pad 361 are also formed to be rounded, so that the same gap g may be maintained.

The microstrip antenna according to the embodiment described above with reference to the drawings may be configured in various numbers at various positions of the edges of the dielectric material substrate, and may be applied to an electronic device by being combined with various types of other antennas. Some examples are shown and described below.

Figure 11:
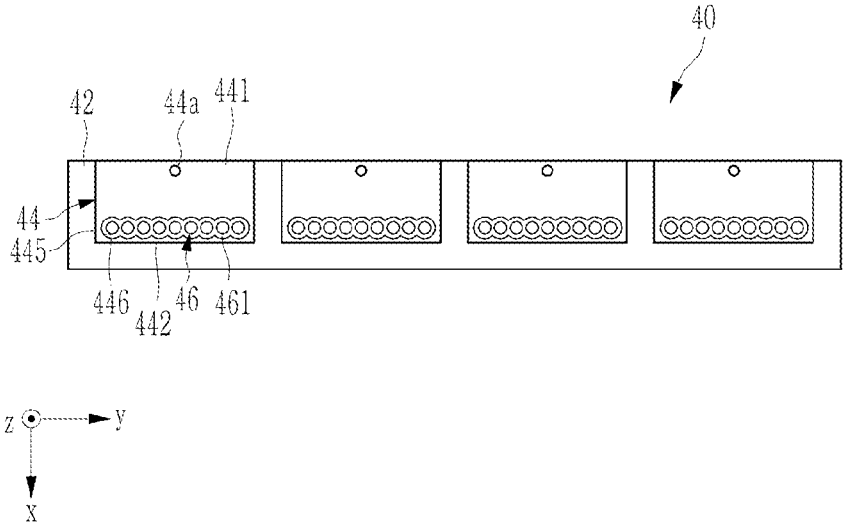
FIG. 11 is a top plan view showing a microstrip antenna according to another embodiment, and shows an antenna in which a microstrip antenna according to an embodiment shown in FIG. 1 is arranged in plural.

FIG. 11 is a top plan view showing a microstrip antenna according to another embodiment, and shows an antenna in which a microstrip antenna according to an embodiment shown in FIG. 1 is arranged in plural.

Referring to FIG. 11, the microstrip antenna 40 according to the present embodiment may include a radiation portion 44 and a coupling member 46 in which a plurality of, for example, four along one edge of the substrate 42, are disposed. At this time, each of the radiation portion 44 and the coupling member 46 may have the same structure as the embodiment described with reference to FIG. 1, and the substrate 42 may be a dielectric material substrate.

That is, each of a plurality of radiation portions 44 may include a conductor 445 and a through opening 446 may be formed in the conductor 445. Each conductor 445 may be formed to have a quadrangle plane shape including, for example, a rectangular shape or square shape.

In addition, each of a plurality of coupling members 46 may include a plurality of circular pads 461. A plurality of circular pads 461 constituting each coupling member 46 may be disposed to be spaced apart from the conductor 445 by a gap within the opening 446 of the conductor 445. In addition, a plurality of circular pads 461 may be arranged to be spaced apart from each other within each opening 446.

On the other hand, a plurality of radiation portions 44 may be disposed to be biased to one side on the substrate 42. Each of the radiation portions 44 has a first edge 441 disposed in close proximity to the feed portion 44*a* and a second edge 442 disposed in close proximity to the opening 446. Accordingly, a plurality of radiation portions 44 may be arranged such that, for example, the first edge 441 is aligned with one edge of the substrate 42. This allows the feed portion 44*a* to be disposed closer to one edge of substrate 42 than to the coupling member 46.

In the present embodiment, an example in which the plurality of microstrip antennas shown in FIG. 1 are arranged is shown, however it may be arranged in plural to configure the antenna in the same type for the structures of the microstrip antennas according to the variation embodiments shown in FIG. 4 and FIG. 5 and the embodiments shown in FIG. 9 and FIG. 10.

Figure 12:
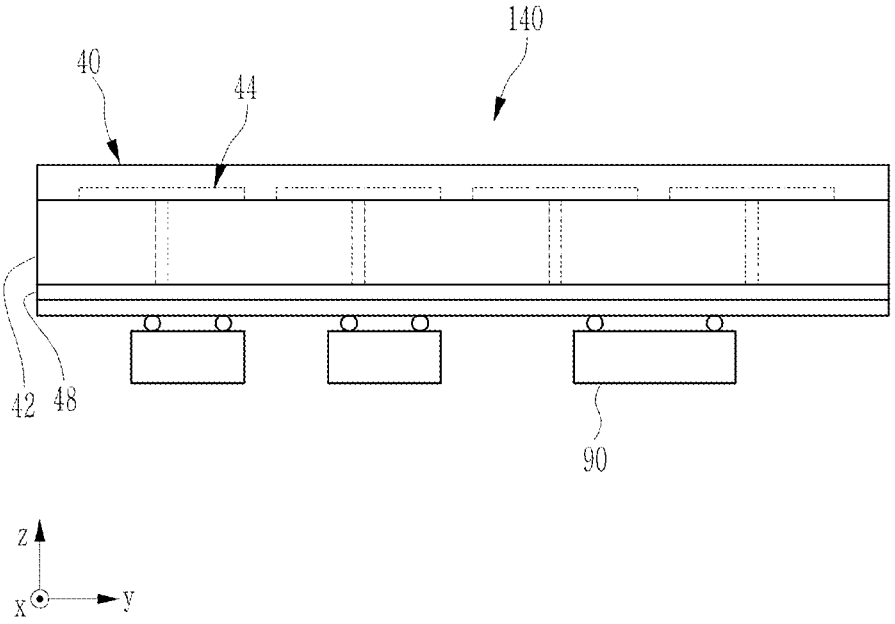
FIG. 12 is a lateral view showing an antenna module including a microstrip antenna according to an embodiment showing in FIG. 11.

FIG. 12 is a lateral view showing an antenna module including a microstrip antenna according to an embodiment showing in FIG. 11.

Referring to FIG. 12, the microstrip antenna module 140 includes a microstrip antenna 40 in which a radiation portion 44 is disposed on one surface of the substrate 42 and a ground portion 48 is disposed on the other surface. At least one electronic element 90 may be mounted on the other surface of the substrate 42 on which the ground portion 48 is positioned.

Figure 13:
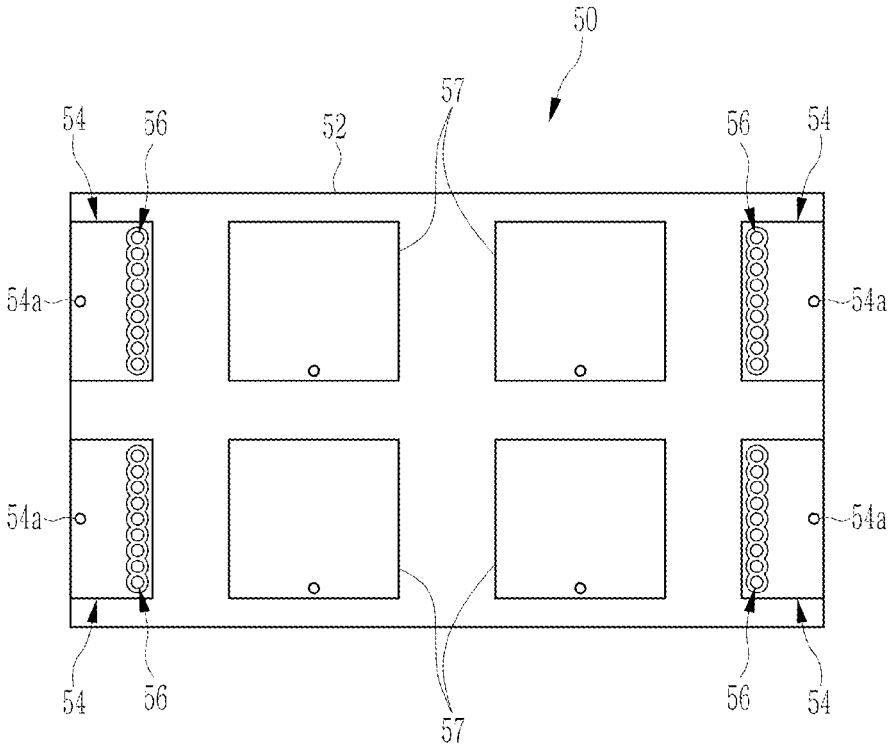
FIG. 13 is a top plan view showing a microstrip antenna according to another embodiment, and shows an antenna in which a microstrip antenna according to an embodiment shown in FIG. 1 and a conventional microstrip antenna are combined and arranged.

The substrate 42 may be a circuit board on which circuit or electronic components required for the microstrip antenna 40 are mounted. For example, the substrate 42 may be a printed circuit board (PCB) in which at least one electronic component is mounted on the surface. Accordingly, a circuit wire for electrically connecting the electronic components may be provided on the substrate 42 and may be composed of a plurality of layers. FIG. 13 is a top plan view showing a microstrip antenna according to another embodiment, and shows an antenna in which a microstrip antenna according to an embodiment shown in FIG. 1 and a conventional microstrip antenna are combined and arranged.

Referring to FIG. 13, the microstrip antenna 50 according to the present embodiment may include a radiation portion 54 and a coupling member 56 disposed in plural, for example, two by two adjacent to each of a pair of edges of the dielectric material substrate 52 facing each other. At this time, each of the radiation portion 54 and the coupling member 56 may have the same structure as the embodiment described with reference to FIG. 1. In addition, between the radiation portions 54 including the coupling member 56, a plurality of quadrangle radiation patches 57, for example, four, may be arranged on the dielectric material substrate 52 in a 2×2 format.

Meanwhile, a plurality of radiation portions 54 may be disposed adjacent to a pair of edges opposing each other on the dielectric material substrate 52. In this case, a plurality of radiation portions 54 may be disposed to be linearly symmetric with respect to the center of the dielectric material substrate 52.

In this case, a pair of radiation portions 54 may be arranged so that the edge adjacent to the feed portion 54*a* on the edge of one side of the dielectric material substrate 52 is aligned to the edge of the dielectric material substrate 52, and the other pair of radiation portions 54 may be arranged so that the edge adjacent to the feed portion 54*a* on the opposite edge of the dielectric material substrate 52 is aligned to the edge of the dielectric material substrate 52.

In the present embodiment, an example in which the microstrip antenna shown in FIG. 1 is combined with the conventional microstrip antenna and arranged in plural is illustrated and described, however it may be combined with the conventional microstrip antenna and arranged in plural to configure the antenna in the same type for the structures of the microstrip antennas according to the variation embodiments shown in FIG. 4 and FIG. 5 and the embodiments shown in FIG. 9 and FIG. 10.

Figure 14:
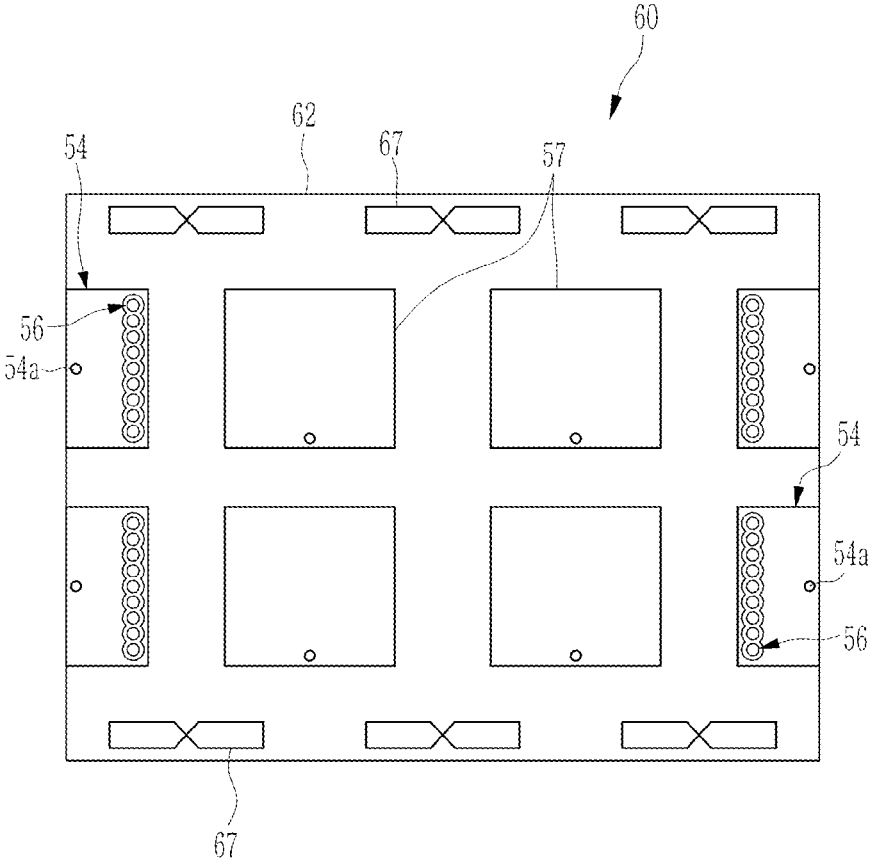
FIG. 14 is a top plan view showing an antenna according to another embodiment, and shows an antenna in which a microstrip antenna according to an embodiment shown in FIG. 1, a conventional microstrip antenna, and a dipole antenna are combined and arranged.

FIG. 14 is a top plan view showing an antenna according to another embodiment, and shows an antenna in which a microstrip antenna according to an embodiment shown in FIG. 1, a conventional microstrip antenna, and a dipole antenna are combined and arranged.

Referring to FIG. 14, the antenna 60 according to the present embodiment basically has the structure of the microstrip antenna shown in FIG. 13. That is, the antenna 60 according to the present embodiment may include a radiation portion 54 and a coupling member 56 that are disposed in plural adjacent to each of a pair of edges facing each other of the dielectric material substrate 62, for example, two by two. In addition, between the radiation portions 54 including the coupling member 56, a plurality of quadrangle radiation patches 57, for example, four, may be arranged on the dielectric material substrate 62 in a 2×2 format.

In the present embodiment, in addition to this, a plurality of dipole antennas 67 may be disposed adjacent to another pair of edges facing each other of the dielectric material substrate 62. That is, in the dielectric material substrate 62, at a pair of the edges that intersect the edges at which the radiation portions 54 including the coupling members 56 are disposed, for example, three dipole antennas 67 may be arranged along each edge.

In the present embodiment, an example in which the microstrip antenna shown in FIG. 1 is combined with the conventional microstrip antennas and the dipole antennas arranged in plural, however the microstrip antenna may be the microstrip antennas according to the variation embodiments shown in FIG. 4 and FIG. 5 and the embodiments shown in FIG. 9 and FIG. 10 and combined with the conventional microstrip antennas and the dipole antennas and arranged in plural to configure the antenna 60.

Also, a configuration of the antenna including a combination of the upper half of the microstrip antenna 60 shown in FIG. 14 or the antenna omitting the upper or lower dipole antenna is also possible.

Figure 15:
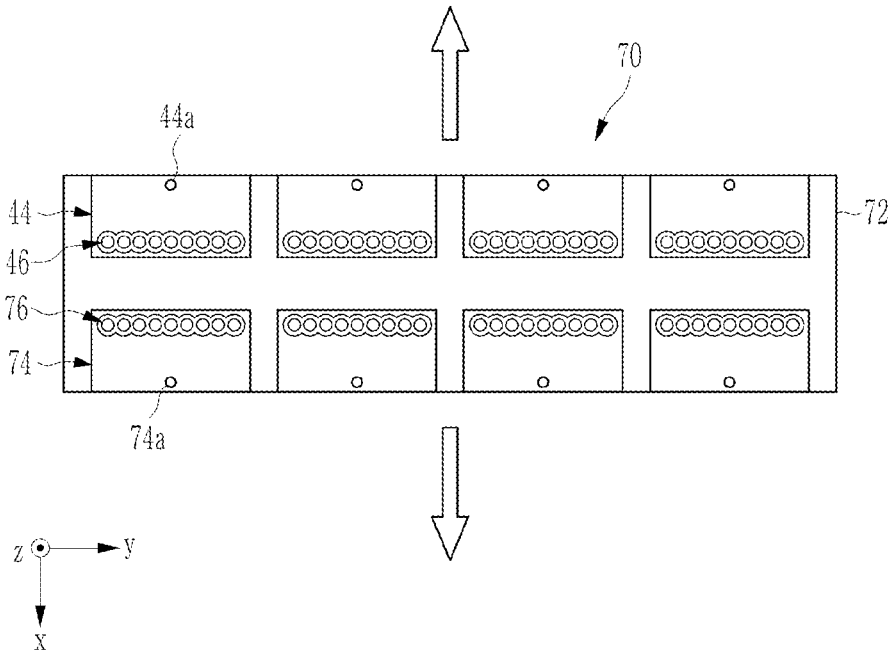
FIG. 15 is a top plan view showing a microstrip antenna according to another embodiment.

FIG. 15 is a top plan view showing a microstrip antenna according to another embodiment.

Referring to FIG. 15, the microstrip antenna 70 according to the present embodiment may include a plurality of radiation portions 44 and 74 and coupling members 46 and 76, for example, four are respectively disposed along the facing edges of the substrate 72. In this case, each of the radiation portions 44 and 74 and the coupling members 46 and 76 may have the same structure as that of the embodiment described with reference to FIG. 1, the variation embodiments shown in FIG. 4 and FIG. 5, and the embodiments shown in FIG. 9 and FIG. 10, and the substrate 72 may be a dielectric material substrate.

A plurality of radiation portions 44 and 74 may be disposed to be biased toward both sides on the substrate 72. That is, the radiation portions 44 and 74 may be disposed such that the feed portions 44*a* and 74*a* face the outside of the substrate 72 and the coupling members 46 and 76 face the inside of the substrate 72. As a result, even in a narrow area, it may be possible to form the beam radiating in both directions as indicated by block arrows.

Figure 16:
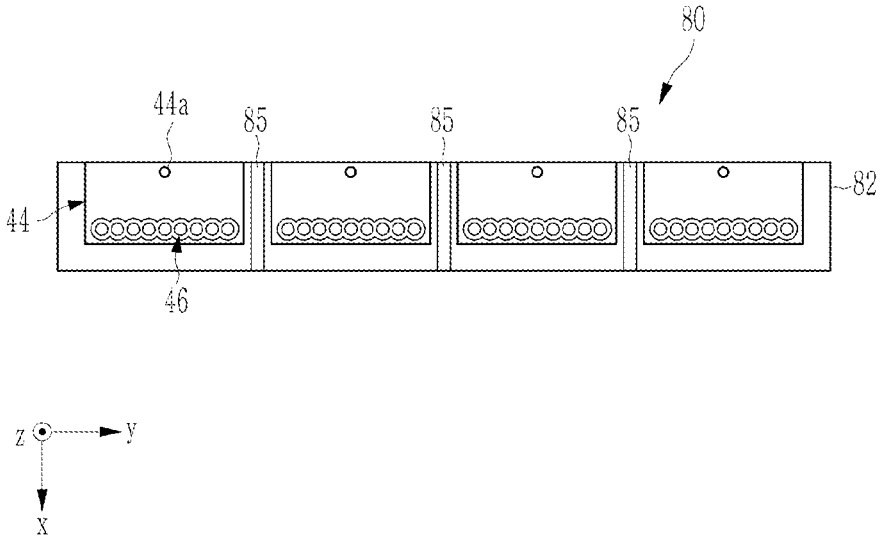
FIG. 16 is a top plan view showing a microstrip antenna according to another embodiment.

FIG. 16 is a top plan view of a microstrip antenna according to another embodiment.

Referring to FIG. 16, the microstrip antenna 80 according to the present embodiment may include a radiation portion 44 and a coupling member 46 disposed in a plurality of sets, for example, four sets, respectively, along one edge of the substrate 82. At this time, each of the radiation portions 44 and the coupling members 46 may have the same structure as the embodiment described with reference to FIG. 1, the variation embodiments shown in FIG. 4 and FIG. 5, and the embodiments shown in FIG. 9 and FIG. 10, and the substrate 82 may be a dielectric material substrate.

In the present embodiment, a ground wall 85 may be disposed between adjacent sets of the radiation portion 44 and the coupling member 46. The ground wall 85 may be extended within the substrate 82 in the thickness direction (a z-axis direction of the drawing) and also in the x-axis direction in the drawing to partition the adjacent sets of the radiation portions 44 and the coupling members 46. This ground wall 85 may reduce interference between the radiation portion 44 and the coupling member 46 in the adjacent sets, thereby reducing the entire area of the microstrip antenna 80.

Figure 17:
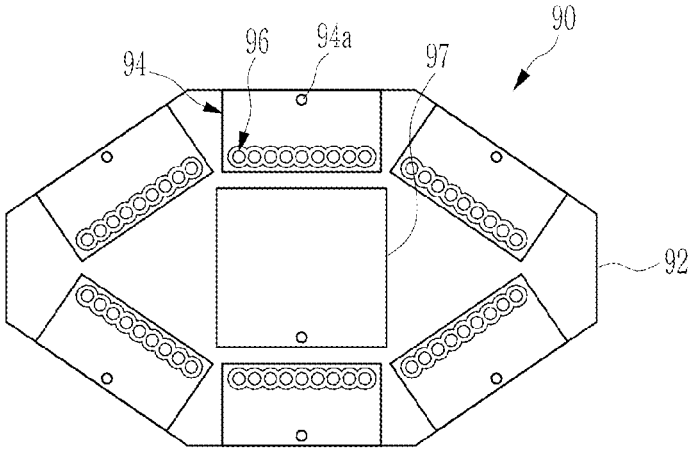
FIG. 17 is a top plan view showing a microstrip antenna according to another embodiment.

FIG. 17 is a top plan view showing a microstrip antenna according to another embodiment.

Referring to FIG. 17, the microstrip antenna 90 according to the present embodiment may include a radiation patch 97 of a quadrangle shape disposed at the center of the dielectric material substrate 92 on a plane, and plural, for example six radiation portions 94 and coupling members 96, may be disposed on the circumference of the radiation patch 97. At this time, each of the radiation portion 94 and the coupling member may have the same structure as that of the embodiment described with reference to FIG. 1, the variation embodiments shown in FIG. 4 and FIG. 5, and the embodiments shown in FIG. 9 and FIG. 10.

Meanwhile, a plurality of radiation portions 94 may be disposed on the dielectric material substrate 92 adjacent to the edge. In this case, a plurality of radiation portions 94 may be disposed to be point symmetric with respect to the center of the dielectric material substrate 92. In addition, each radiation portion 94 may be arranged such that the edge close to the feed portion 94*a* at the edge of the dielectric material substrate 92 is aligned with the edge of the dielectric material substrate 92.

The antenna according to the embodiments described above with reference to the drawings may be applied to and operated in an electronic device to implement down-sizing and beamforming. Some examples are shown and described below.

Figure 18:
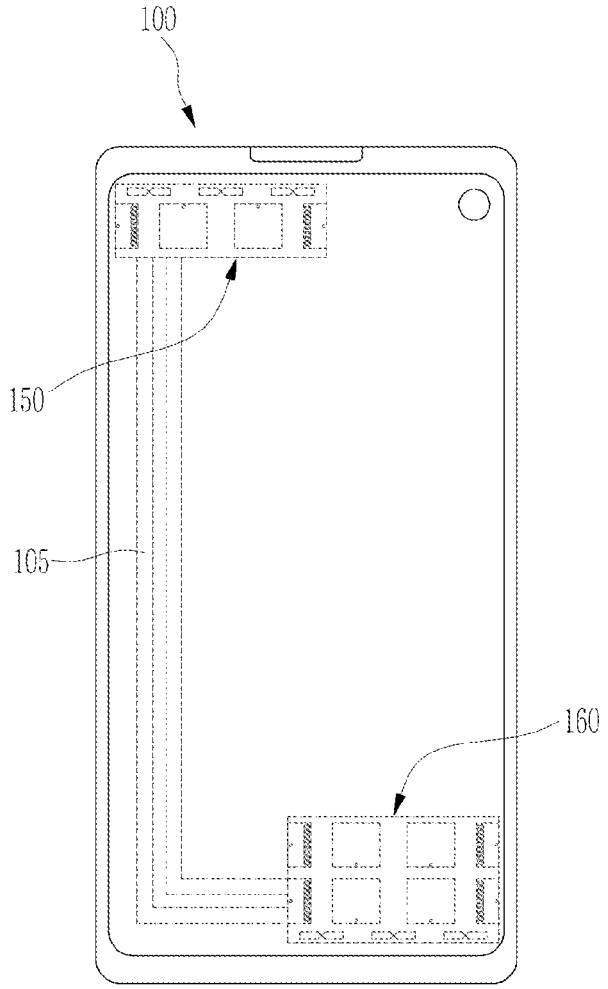
FIG. 18 is a top plan view showing an electronic device to which a microstrip antenna according to one or more embodiments is mounted.
Figure 19:
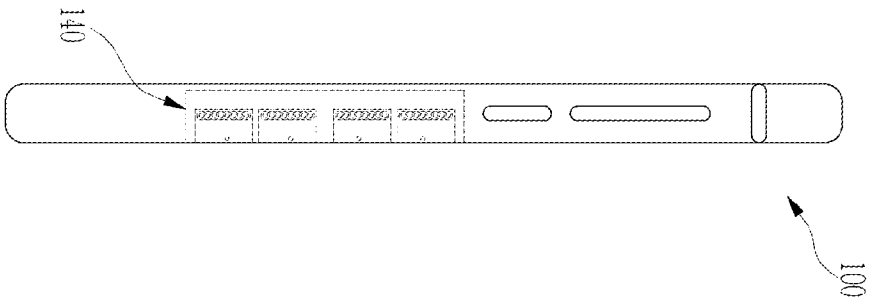
FIG. 19 is a lateral view showing an electronic device to which a microstrip antenna according to one or more embodiments is mounted.

FIG. 18 is a top plan view showing an electronic device to which a microstrip antenna according to the embodiments described herein is mounted, and FIG. 19 is a lateral view showing an electronic device to which a microstrip antenna according to the embodiments described herein is mounted.

The electronic device 100 according to the embodiments may be configured by disposing antenna modules 140, 150, and 160 including the antennas 40, 50, and 60 according to the above-described embodiments or an antenna that is partially modified thereof on a built-in set substrate. The electronic device 100 may include polygonal sides, and the antenna modules 140, 150, and 160 may be disposed adjacent to at least a portion of a plurality of sides of the electronic device 100.

Referring to FIG. 18, the antenna modules 150 and 160 configured by combining the radiation portion including the coupling member, the quadrangle radiation patch, and the dipole antenna may be disposed adjacent to the upper left and lower right corners of, for example, the electronic device 100, and these antenna modules 150 and 160 may be electrically connected to each other through, for example, a flexible printed circuit (FPC) substrate 105 or the like.

Here, the antenna module 150 may include an antenna configuration corresponding to half of the antenna 60 shown in FIG. 14. Therefore, the dipole antenna is disposed to the upper edge of the dielectric material substrate, and the microstrip antenna having the coupling member is disposed on the left and right edges and the radiation patch of the microstrip antenna may be disposed between them.

Also, the antenna module 160 may include the antenna configuration excluding the dipole antennas arranged at one edge in the antenna 60 shown in FIG. 14. Therefore, the dipole antenna is disposed to the lower edge of the dielectric material substrate, and a pair of microstrip antennas having the coupling member are respectively disposed on the left and right edges and the radiation patch of the microstrip antenna may be disposed between them.

Referring to FIG. 19, the antenna module 140 including the microstrip antenna 40 shown in FIG. 11 may be mounted on the inner side of the electronic device 100. Since the microstrip antenna 40 has a narrow width and a shape that is elongated in one direction, it may be suitable for mounting on the side of the electronic device 100 having a thin thickness.

The electronic device 100 shown in FIG. 18 and FIG. 19 may be realized by mounting the antenna module including the microstrip antenna according to the embodiments described in the present specification as well as the antenna modules 140, 150, and 160 of the shown examples.

On the other hand, the electronic device 100 may be a smart phone, a personal digital assistant, a digital video camera, a digital still camera, a network system, a computer, a monitor, a tablet, a laptop, a netbook, a television, a video game, a smart watch, an automotive part, and the like, however it is not limited thereto.

According to the microstrip antenna disclosed in one or more embodiments described herein, the beamforming may be performed by easily changing the direction of the beam by adjusting the gap between the coupling member and the radiation portion in a down-sized antenna structure.

In addition, it is possible to dispose and mount the microstrip antenna according to the one or more embodiments in the reduced antenna space of the down-sized, lightened, and thinned electronic device, and by using this microstrip antenna, beamforming that is suitable for electronic devices may be easily performed without addition of an antenna pattern or a complicated design.

While specific example embodiments have been shown and described above, it will be apparent after an understanding of this disclosure that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna comprising:

a substrate;

a radiation portion connected to a feed line, disposed on a layer of the substrate, and including a conductor having an opening; and a coupling member connected to a ground portion and disposed within the opening spaced apart from the conductor by a gap, wherein the coupling member comprises a plurality of pads spaced apart from each other within the opening.

2. The antenna of claim 1, wherein the radiation portion and the coupling member are disposed at least partially on the same layer.

3. The antenna of claim 1, wherein the radiation portion comprises a first edge and a second edge facing each other, and wherein the feed line is disposed closer to the first edge of the radiation portion than the opening.

4. The antenna of claim 3, wherein the opening is elongated along the second edge of the radiation portion.

5. The antenna of claim 4, wherein the coupling member comprises a plurality of circular pads spaced apart from each other within the opening.

6. The antenna of claim 5, wherein the opening comprises a plurality of concave portions respectively corresponding to the plurality of circular pads and formed such that the conductor is protruded to surround the edge shape of each circular pad.

7. The antenna of claim 4, wherein the coupling member comprises a strip-shaped pad elongated along the edge of the opening.

8. The antenna of claim 3, wherein the opening comprises a plurality of circular openings spaced apart from each other along the second edge of the radiation portion.

9. The antenna of claim 8, wherein the coupling member comprises a plurality of circular pads each positioned to correspond to a circular opening of the plurality of circular openings.

10. The antenna of claim 3, wherein the radiation portion is disposed to be biased to one side on the substrate so that the first edge is aligned with one edge of the substrate.

11. The antenna of claim 1, wherein the coupling member is connected to the ground portion through a conductive via extending in a thickness direction of the substrate, and wherein the coupling member comprises a greater width than the diameter of the conductive via.

12. The antenna of claim 1, wherein the antenna is a microstrip antenna.

13. The antenna of claim 1, wherein the substrate is a dielectric material.

14. An electronic device comprising the antenna of claim 1.

15. The electronic device of claim 14, further comprising one or more of a dipole antenna and a radiation patch.

16. An antenna module comprising:

a substrate;

at least one antenna disposed on one surface of the substrate; and at least one electronic element mounted on an other surface of the substrate, wherein the antenna comprises:

a radiation portion connected to a feed line, disposed on a layer of the substrate, and including a conductor having an opening, and a coupling member connected to a ground portion and disposed within the opening spaced apart from the conductor by a gap, wherein the coupling member comprises a plurality of pads spaced apart from each other within the opening.

17. The antenna module of claim 16, wherein the radiation portion and the coupling member are disposed at least partially on the same layer.

18. The antenna module of claim 16, wherein the radiation portion comprises a first edge and a second edge facing each other, and wherein the feed line is disposed closer to the first edge of the radiation portion than the opening.

19. The antenna module of claim 16, wherein the opening is elongated along the second edge of the radiation portion.

20. The antenna module of claim 16, wherein the coupling member comprises a plurality of circular pads spaced apart from each other within the opening.

21. An electronic device comprising the antenna module of claim 16.

22. The electronic device of claim 21, wherein the antenna module further comprises one or more of a dipole antenna and a radiation patch.

23. An antenna comprising:

a radiation portion comprising a conductor, an opening through the conductor configured to surround a coupling member in the opening with a gap between the conductor and the coupling member, and a feed portion disposed spaced apart from the opening, wherein the opening and the feed portion are disposed at facing edges of the conductor, wherein the coupling member comprises a plurality of pads, and wherein the opening comprises a plurality of openings connected to each other and corresponding to the plurality of pads.

24. The antenna of claim 23, further comprising:

a feed line connected to the feed portion; and the coupling member disposed in the opening connected to a ground portion through a substrate, wherein the conductor is disposed on the substrate.

25. The antenna of claim 23, wherein the radiation portion and the coupling member are disposed at least partially on the same layer.

26. The antenna of claim 23, wherein the coupling member comprises a plurality of pads disposed in a row near an edge of the facing edges opposite to the feed portion.

27. The antenna of claim 23, further comprising a via connected to the ground portion, and extending to the coupling member, wherein the coupling member extends from the via toward the conductor in the opening.

28. An electronic device comprising the antenna module of claim 23.

29. An electronic device comprising:

an antenna comprising:

a radiation portion comprising an opening and a feed portion spaced apart from the opening, wherein the opening and the feed portion are disposed at facing edges of the radiation portion, and a coupling member connected to a ground portion disposed in the opening and spaced apart from the radiation portion by a gap, wherein the coupling member comprises a plurality of pads, and wherein the opening comprises a plurality of openings connected to each other and corresponding to the plurality of pads.

30. The electronic device of claim 29, wherein the antenna further comprises:

a substrate, wherein the radiation portion is disposed on the substrate; and a feed line connected to the feed portion, wherein the coupling portion is connected to the ground portion through the substrate.

* * * * *